US009027220B2

(12) United States Patent
Schlafhauser

(10) Patent No.: US 9,027,220 B2
(45) Date of Patent: May 12, 2015

(54) RIVET SETTING MACHINE

(75) Inventor: Joseph Karl Schlafhauser, Troy, MI (US)

(73) Assignee: Newfrey LLC, Newark, DE (US)

( * ) Notice: Subject to any disclaimer, the term of this patent is extended or adjusted under 35 U.S.C. 154(b) by 282 days.

(21) Appl. No.: 13/568,700

(22) Filed: Aug. 7, 2012

(65) Prior Publication Data

US 2014/0041193 A1 Feb. 13, 2014

(51) Int. Cl.

| | |
|---|---|
| ***B21J 15/02*** | (2006.01) |
| *B21J 15/10* | (2006.01) |
| *B21J 15/26* | (2006.01) |
| *B21J 15/28* | (2006.01) |

(52) U.S. Cl.

CPC ..... *B21J 15/025* (2013.01); *B21J 15/105* (2013.01); *B21J 15/26* (2013.01); *B21J 15/28* (2013.01); *B21J 15/285* (2013.01)

(58) Field of Classification Search

CPC ..... B21J 15/025; B21J 15/105; B21J 15/26; B21J 15/28

USPC ..... 29/432, 432.1, 432.2, 525.06, 798, 29/243.53; 702/158

See application file for complete search history.

(56) References Cited

U.S. PATENT DOCUMENTS

| | | | |
|---|---|---|---|
| 1,483,919 | A | 2/1924 | Walker |
| 1,611,876 | A | 12/1926 | Berger |
| 2,342,089 | A | 2/1944 | Rossmann |
| 2,374,899 | A | 5/1945 | Sasgen |
| 2,465,534 | A | 3/1949 | Havener |
| 2,493,868 | A | 1/1950 | Griffin |
| 3,557,442 | A | 1/1971 | Speller |
| 3,778,537 | A | 12/1973 | Miller |
| 3,811,313 | A | 5/1974 | Schut |
| 3,958,389 | A | 5/1976 | Whiteside et al. |
| 3,961,408 | A | 6/1976 | Goodsmith et al. |
| 4,044,462 | A | 8/1977 | Anselmo |
| 4,096,727 | A | 6/1978 | Gargaillo et al. |
| 4,128,000 | A | 12/1978 | Hogenhout et al. |
| 4,132,108 | A | 1/1979 | Hogenhout |
| 4,151,735 | A | 5/1979 | McDermott |

(Continued)

FOREIGN PATENT DOCUMENTS

| | | | | |
|---|---|---|---|---|
| CN | 1113837 | A | 12/1995 | |
| CN | 102513494 | A * | 6/2012 | ..... B21J 15/00 |

(Continued)

OTHER PUBLICATIONS

"Assembly instructions for Emhart Teknologies Tucker LM 310 stud welding machine (believed to have been offered for sale or published prior to Jul. 2011)", 15 pages.

(Continued)

*Primary Examiner* — Essama Omgba

(74) *Attorney, Agent, or Firm* — Harness, Dickey & Pierce, P.L.C.

(57) ABSTRACT

A rivet setting machine is provided. In another aspect, a linear displacement sensor directly senses and detects a position of a rivet-setting punch relative to a nosepiece of a rivet setting machine. A further aspect provides a control system and software instructions for sensing the relative position of a punch and nosepiece used by a programmable controller to determine and monitor a rivet setting position without use of a force sensor, motor current/voltage sensor, or a rotation sensor.

29 Claims, 8 Drawing Sheets

(56) References Cited

U.S. PATENT DOCUMENTS 4,192,058 A 3/1980 Falcioni
4,208,153 A 6/1980 Trethewy
4,365,401 A 12/1982 Ogren
4,384,667 A 5/1983 Smallegan et al.
4,459,073 A 7/1984 Muller
4,511,074 A 4/1985 Kille et al.
4,543,701 A 10/1985 Muller
4,553,074 A 11/1985 Jacquemet
4,555,838 A 12/1985 Muller
4,566,182 A 1/1986 Altwicker et al.
4,574,453 A 3/1986 Sawdon
4,582,238 A 4/1986 Bennett et al.
4,615,475 A 10/1986 Fuhrmeister
4,620,656 A 11/1986 McClay et al.
4,625,903 A 12/1986 Becht
4,633,560 A 1/1987 Muller
4,662,556 A 5/1987 Gidlund
4,676,421 A 6/1987 Swanstrom
4,726,504 A 2/1988 Halbert
4,727,646 A 3/1988 Muller
4,765,057 A 8/1988 Muller
4,848,592 A 7/1989 Shemeta
4,858,481 A 8/1989 Abraham
4,901,431 A 2/1990 Gast
4,908,928 A 3/1990 Mazurik et al.
4,911,592 A 3/1990 Muller
4,915,558 A 4/1990 Muller
4,955,119 A 9/1990 Bonomi et al.
4,964,314 A 10/1990 Wilkes
4,999,896 A 3/1991 Mangus et al.
5,042,137 A 8/1991 Speller, Sr.
5,056,207 A 10/1991 Ladouceur
5,060,362 A 10/1991 Birke et al.
5,086,965 A 2/1992 Marsteller et al.
5,131,130 A 7/1992 Eshghy
5,131,255 A 7/1992 Fushiya et al.
5,140,735 A 8/1992 Ladouceur
5,169,047 A 12/1992 Endres et al.
5,193,717 A 3/1993 Rink et al.
5,196,773 A 3/1993 Yoshikawa et al.
5,201,892 A 4/1993 Salter
5,207,085 A 5/1993 Hopkins et al.
5,212,862 A 5/1993 Eshghy
5,216,819 A 6/1993 Givler
5,222,289 A 6/1993 Michalewski et al.
5,231,747 A 8/1993 Clark et al.
5,259,104 A 11/1993 Givler
5,277,049 A 1/1994 Endo
5,329,694 A 7/1994 Sickels et al.
5,331,831 A 7/1994 Schneider
5,339,598 A 8/1994 Rink et al.
5,398,537 A 3/1995 Michalewski et al.
5,471,729 A 12/1995 Zoltaszek
5,471,865 A 12/1995 Michalewski et al.
5,472,087 A 12/1995 Rink et al.
5,473,805 A 12/1995 Wille
5,487,215 A 1/1996 Ladouceur
5,491,372 A 2/1996 Erhart
5,502,884 A 4/1996 Ladouceur
5,510,940 A 4/1996 Tacklind et al.
5,531,009 A 7/1996 Givler
5,533,250 A 7/1996 Ladouceur
5,544,401 A 8/1996 Danino
5,557,154 A 9/1996 Erhart
5,575,166 A 11/1996 Michalewski et al.
5,581,587 A 12/1996 Satoh et al.
5,615,474 A 4/1997 Kellner et al.
5,626,055 A 5/1997 Fukui
5,655,289 A 8/1997 Wille et al.
RE35,619 E 10/1997 Muller
5,673,839 A 10/1997 Howard et al.
5,752,305 A 5/1998 Cotterill et al.
5,779,127 A 7/1998 Blacket et al.
5,795,114 A 8/1998 Schweizer et al.
5,802,691 A 9/1998 Zoltaszek
5,809,833 A 9/1998 Newport et al.
5,829,115 A 11/1998 Speller, Jr. et al.
5,893,203 A 4/1999 Buttrick, Jr.
5,911,458 A 6/1999 Bywalez et al.
5,957,362 A 9/1999 Samulowitz et al.
6,011,482 A 1/2000 Banks et al.
6,014,802 A 1/2000 Guerin
6,014,804 A 1/2000 Lulay et al.
6,058,598 A * 5/2000 Dixon et al. ..... 29/714
6,067,696 A 5/2000 Cecil et al.
6,089,062 A 7/2000 Zemp
6,148,507 A 11/2000 Swanson et al.
6,150,917 A 11/2000 Meyer et al.
6,196,414 B1 3/2001 Ferenczi et al.
6,199,271 B1 3/2001 Hahn et al.
6,219,898 B1 4/2001 Kubanek et al.
6,240,758 B1 * 6/2001 Nagakura ..... 72/20.1
6,276,050 B1 * 8/2001 Mauer et al. ..... 29/716
6,347,449 B1 2/2002 Calkins et al.
6,357,100 B2 3/2002 Speller, Jr. et al.
6,385,843 B1 5/2002 Singh et al.
6,405,420 B1 6/2002 Donhauser et al.
6,502,008 B2 12/2002 Maurer et al.
6,511,061 B1 1/2003 Ferenczi et al.
6,523,245 B2 2/2003 Whiten et al.
6,543,115 B1 4/2003 Mauer et al.
6,543,121 B2 4/2003 Speller, Jr. et al.
6,688,489 B2 2/2004 Bloch et al.
6,692,213 B1 2/2004 Butler
6,725,521 B1 4/2004 Blacket et al.
6,742,235 B2 6/2004 Blacket et al.
6,789,309 B2 * 9/2004 Kondo ..... 29/709
6,857,175 B2 2/2005 Blocher et al.
6,942,134 B2 9/2005 Naito
6,944,944 B1 9/2005 Craythorn et al.
6,951,052 B2 10/2005 Clew
6,961,984 B2 11/2005 Naito et al.
7,024,270 B2 4/2006 Mauer et al.
7,032,296 B2 * 4/2006 Zdravkovic et al. ..... 29/709
7,109,434 B2 9/2006 Willershausen
7,119,302 B2 10/2006 Schmitt et al.
7,123,982 B2 10/2006 Mauer et al.
7,131,564 B2 11/2006 Matthews et al.
7,200,909 B2 4/2007 Peckham et al.
7,313,851 B2 * 1/2008 Wang et al. ..... 29/243.523
7,313,852 B2 1/2008 Peckham et al.
7,331,098 B2 2/2008 Matthews et al.
7,370,399 B2 5/2008 Lang et al.
7,409,760 B2 * 8/2008 Mauer et al. ..... 29/715
7,475,468 B2 1/2009 Mauer et al.
7,487,583 B2 2/2009 Craythorn et al.
7,559,133 B2 * 7/2009 Chitty et al. ..... 29/716
7,572,739 B2 * 8/2009 Codding et al. ..... 438/745
7,658,089 B2 2/2010 Zdravkovic et al.
7,673,377 B2 3/2010 Clew
7,721,405 B2 5/2010 Lang et al.
7,730,798 B2 * 6/2010 Linden et al. ..... 73/866.5
7,752,739 B2 7/2010 Mauer et al.
7,756,672 B2 * 7/2010 Schmall et al. ..... 702/158
7,788,780 B2 9/2010 King
7,797,126 B2 * 9/2010 Wenzel et al. ..... 702/158
7,802,352 B2 9/2010 Chitty et al.
7,810,231 B2 10/2010 Naitoh
7,832,074 B2 * 11/2010 Stevenson et al. ..... 29/407.01
7,856,704 B2 12/2010 Wang et al.
7,878,041 B2 2/2011 Alvarez
7,908,727 B2 3/2011 Clew
7,926,161 B2 * 4/2011 Gerhardt et al. ..... 29/525.01
8,082,647 B2 12/2011 Patton
8,146,240 B2 * 4/2012 Mauer et al. ..... 29/716
8,256,090 B2 * 9/2012 Gerhardt et al. ..... 29/525.01
8,316,524 B1 * 11/2012 LeMieux ..... 29/524.1
2001/0003859 A1 * 6/2001 Mauer et al. ..... 29/407.04
2002/0029450 A1 * 3/2002 Kondo ..... 29/407.01
2003/0074102 A1 * 4/2003 Mauer et al. ..... 700/175
2006/0070222 A1 * 4/2006 Clew ..... 29/407.02
2006/0099859 A1 * 5/2006 Kaspar ..... 439/676
2006/0200273 A1 9/2006 Lang
2006/0207079 A1 * 9/2006 Mauer et al. ..... 29/243.53

(56) References Cited

U.S. PATENT DOCUMENTS

| | | | | |
|---|---|---|---|---|
| 2007/0067975 | A1* | 3/2007 | Gerhardt et al. | 29/407.1 |
| 2007/0067986 | A1* | 3/2007 | Chitty et al. | 29/812.5 |
| 2007/0175010 | A1* | 8/2007 | Wang et al. | 29/243.521 |
| 2007/0271764 | A1* | 11/2007 | Stevenson et al. | 29/522.1 |
| 2008/0177512 | A1* | 7/2008 | Wenzel et al. | 703/1 |
| 2010/0275438 | A1* | 11/2010 | Mauer et al. | 29/716 |
| 2011/0113613 | A1 | 5/2011 | Gamboa et al. | |
| 2011/0162185 | A1* | 7/2011 | Gerhardt et al. | 29/407.01 |
| 2012/0017728 | A1 | 1/2012 | Schmidt | |
| 2013/0192050 | A1* | 8/2013 | LeMieux | 29/524.1 |
| 2013/0263433 | A1* | 10/2013 | Stoian | 29/525.06 |

FOREIGN PATENT DOCUMENTS

| | | | | | |
|---|---|---|---|---|---|
| CN | 102513496 | A | * | 6/2012 | B21J 15/28 |
| CN | 203292795 | U | * | 11/2013 | B23P 19/027 |
| DE | 1292112 | B | | 4/1969 | |
| DE | 4019467 | A1 | | 1/1992 | |
| DE | 9215475 | U1 | | 1/1993 | |
| DE | 4214475 | A1 | | 11/1993 | |
| DE | 4419065 | A1 | | 12/1995 | |
| DE | 4429225 | A1 | | 2/1996 | |
| DE | 19718576 | A1 | | 11/1998 | |
| EP | 129358 | A2 | | 12/1984 | |
| EP | 482360 | A2 | | 4/1992 | |
| EP | 642853 | A1 | | 3/1995 | |
| EP | 685662 | A2 | | 12/1995 | |
| EP | 772033 | A2 | | 5/1997 | |
| EP | 1875976 | A1 | | 1/2008 | |
| FR | 2290970 | A1 | | 6/1976 | |
| FR | 2350901 | A2 | | 12/1977 | |
| GB | 1476227 | A | | 6/1977 | |
| GB | 1487098 | A | | 9/1977 | |
| GB | 2300183 | A | | 10/1996 | |
| JP | 52134180 | A | | 11/1977 | |
| JP | 52135960 | A | | 11/1977 | |
| JP | 56077042 | A | | 6/1981 | |
| JP | 58131939 | A | | 9/1983 | |
| JP | 62109838 | A | | 7/1987 | |
| JP | 63002534 | A | | 1/1988 | |
| JP | 6440132 | | | 2/1989 | |
| JP | 4169828 | A | | 6/1992 | |
| JP | 592300 | | | 4/1993 | |
| JP | 6061344 | A | | 3/1994 | |
| JP | 7015135 | A | | 1/1995 | |
| JP | 7108497 | A | | 4/1995 | |
| KR | 20030009889 | A | * | 2/2003 | B21J 15/32 |
| RU | 1696081 | | | 12/1991 | |
| WO | WO-9115316 | A1 | | 10/1991 | |
| WO | WO-9310925 | A1 | | 6/1993 | |
| WO | WO-9324258 | A1 | | 12/1993 | |
| WO | WO-9535174 | A1 | | 12/1995 | |
| WO | WO-03013759 | A1 | | 2/2003 | |
| WO | WO 2014025608 | A1 | * | 2/2014 | B21J 5/02 |

OTHER PUBLICATIONS

"Brochure: Magnetic Length Sensor MLS, measurement specialities Inc. (published 2009)", pp. 1-6.
Lin et al., "Development of Monitoring and Control Precise Riverting System using Wireless Internet", IEEE, 2006, pp. 4420-4424.
"Brochure: Small Optical Encoder Modules—Technical Data, Agilent Technologies (published 2002)", 13 pages.
"Description of sensing system in Emhart servodriven SPR machine attached to robot (offered for sale in U.S. prior to Jul. 2011)", pp. 1-12.
"New From Tucker: The Perfection of Self Piercing Riveting Technology", Emhart Tucker, (published prior to Jun. 2012), 6 pages.
"Assembly Instructions for Emhart Teknologies Tucker LM 310 stud welding head machine (published Feb. 2010)", pp. 1-45.
"Weiterentwicklung der Stanzniettechnik", Lothar Budde, Wilhelm Lappe, Fritz Lliebrecht, Dietmar Sube, 1992, pp. 310-314.
Declaration of Kenneth Edwards from non-equivalent EPO self-piercing rivet machine application.
Affidavit of John R. Perkins (with exhibits) from non-equivalent EPO self-piercing rivet machine application.
Affidavit of John Russell from non-equivalent EPO self-piercing rivet machine application.
aT Angewandte Technik Niettechnik + Alaternativen, 1991, pp. 34-38.
"Dubbel Taschenbuch fur den Maschinenbau", W. Beitz, K.H. Kuttner, 1981, pp. 370-371.
"Ein Angebot mit Lucken Blech '90 in Essen: Elemente und Gerate zum Fugen", Bander Bleche Rohre 1—1991, pp. 52-56, with English translation.
"Qualitatssicherung in der Niettechnik" Lothar Budde, Uwe Klemens, Wilhelm Lappe, Oct. 1990.
1.6 Riveted Joints, K. Federn, Berlin, 1.6.1 Claims. Stresses in Rivets and Plates, prior to Jul. 20, 1998, pp. 1-3.
An Offer with Gaps, Blech '90 [Plate '90] in Essen: Element and Equipment for Joining, prior to Jul. 20, 1998, pp. 1-5.
Quality Assurance in Riveting Technology, Lothar Budde, Uwe Klemens, Wilhelm Lappe, Oct. 9, 1990, pp. 1-16.
Sheet Metal Industries, Advanced Car Bodies Trigger New Fastening Technology, Oct. 1992, pp. 14, 16.
Nissan Motor Co. Ltd., Patent Abstract of Japan 07108497, Processing Gun Using Piezoelectric Element and its Control Device, Dec. 10, 1993.
German Patent No. DE 44 19 065 Abstract (English Translation), Dec. 7, 1995.
Biforce 40 System Description Installation User Manual, Ver. E2.1a (Sep. 27, 1995), Binar Elektronik AB (published prior to Apr. 1997).
European Search Report, 3 pages for EP 01 30 1512 dated May 20, 2002.
Aluminum Industry the Application Magazine vol. 11, No. 5, Oct./Nov. 1992, Edwards "Pierce-&-Roll riveting—the alternative to spot-welding" pp. 24-26.
IBEC Engineering Conference—"Proceedings: Body Assembly & Manufacturing," Sep. 26-29, 1994, Detroit, MI, pp. 1-9.
Stephen P. Sunday, International Congress & Exposition, SAE Technical Paper Series, "Self-Piercing Rivets for Aluminum Components," Feb. 28-Mar. 4, 1983, 14 pages.
Automotive Design Engineering 1994, Vehicle & Component Manufacturing, "Self-piercing riveting—a solution for body and chassis combinations," pp. 175-178.
Roger Doo, "Automotive body construction using self-piercing riveting," 1983, 4 pages.
International Search Report for International Application No. PCT/GB93/02608, Apr. 21, 1994, 2 pages.
Lothar Budde and Wilhelm Lappe, "Stanznieten ist zukunfttrachtig in der Blechverarbeitung," 1991, pp. 94-100.
Lothar Budde and Wilhelm Lappe, "Self-piercing riveting is pointing the way forward in metal processing," May 1999, 7 pages.
International Search Report for International Application No. PCT/US94/10232, Jan. 2, 1995, 2 pages.
How Things Work 1, vol. 1, 1974, 3 pages.
Correspondence from National Rivet & Mfg. Co. to Henrob Corporation from non-equivalent EPO self-piercing rivet machine application, Jul. 16, 2001, 3 pages.
Correspondence from Chicago Rivet to Henrob Corporation, Jul. 16, 2001, e pages.
Affidavit of John J. Vrana, Jul. 17, 2001 from non-equivalent EPO self-piercing rivet machine application, 2 pages.
International Search Report for International Application No. PCT/US97/15929, Oct. 17, 1997, 3 pages.
Kenneth Edwards, "Pierce-&-Roll riveting—the alternative to spot welding," Aluminum Industry, The Applications Magazine, Oct./Nov. 1992, 5 pages.
Opposition filed by third party (Bollhoff) from non-equivalent EPO self-piercing rivet machine application, 251 pages.
Daimler Writ of Opposition to DE 197 31 222 from non-equivalent EPO self-piercing rivet machine application, Dec. 15, 2009, 12 pages, with translation.
Tox Writ of Opposition to DE 197 31 222 from non-equivalent EPO self-piercing rivet machine application, Dec. 22, 2009, 16 pages, with translation.

(56) References Cited

OTHER PUBLICATIONS

Kerb Konus Writ of Opposition to DE 197 31 222 from non-equivalent EPO self-piercing rivet machine application, Jul. 1, 2010, 31 pages, with translation.
W. Lappe, O. Hahn—Möglichkeiten der Prozeβüberwachung und Prozeβregelung beim Durchsetzfügen und Stanznieten, 1993, pp. 79-88.
Ortwin Hahn, Wilhelm Lappe—Studiengesellschaft Stahlanwendung e.V. Forschung für die Praxis, 1995, 18 pages (Analyses of process reliability of self-piercing/punching riveting methods when joining surface-coated thin sheets), with translation.
Roger Doo, David Manley-Reeve—Self piercing riveting—a solution for body and chassis combinations, Automotive Design Engineering 1994, pp. 175-178.
English translation of CN 1113837.

* cited by examiner

RIVET SETTING MACHINE

BACKGROUND AND SUMMARY

The present disclosure relates generally to rivet setting, and more particularly to linear displacement sensing within a rivet setting machine.

Automated and robotically moved rivet setting machines are known. Exemplary machines for use with self-piercing rivets are disclosed in the following U.S. patents: U.S. Pat. No. 8,146,240 entitled "Riveting System and Process for Forming a Riveted Joint" which issued to Mauer et al. on Apr. 3, 2012; U.S. Pat. No. 7,559,133 entitled "Riveting System" which issued to Chitty et al. on Jul. 14, 2009; and U.S. Pat. No. 6,789,309 entitled "Self-Piercing Robotic Rivet Setting System" which issued to Kondo on Sep. 14, 2004. All of these patents are incorporated by reference herein. While these prior patents have been significant advances in the field, their automated control complexity is not always required for some more simple rivet setting situations. For example, these prior automated control systems are not always as fast as sometimes desired for each rivet setting cycle due to the many actions being sensed and compared, such as force sensing with a load cell, and electric motor current and/or voltage sensing.

Another conventional device is disclosed in U.S. Pat. No. 6,951,052 entitled "Fastener Insertion Apparatus and Method" which issued to Clew on Oct. 4, 2005, and is incorporated by reference herein. It is noteworthy that column 9, lines 20-25, of the Clew patent state that the "present method of maintaining the velocity of the cylinder part of the linear actuator so as to deliver a predetermined amount of energy to the rivet insertion process without relying on positional or force sensors eliminates those control problems." Thus, Clew teaches away from use of a positional sensor and instead uses an angular velocity encoder which adds a different level of complexity since this is an indirect measurement based on electric motor control, including all of the component tolerance variations and component backlash gaps associated with its pulleys, belts, shafts, plunger and the like, thereby leading to inaccuracies.

In accordance with the present invention, a rivet setting machine is provided. In another aspect, a linear displacement sensor directly senses and detects a position of a rivet-setting punch relative to a nosepiece of a rivet setting machine. A further aspect provides a control system and software instructions for sensing the relative position of a punch and nosepiece used by a programmable controller to determine and monitor a rivet setting position without use of a force sensor, motor current/voltage sensor, or a rotation sensor. A method of operating a rivet setting machine is also provided.

The present rivet setting machine is advantageous over conventional devices. For example, in one aspect, the present machine, system and method allow for a much faster rivet setting cycle time due to the less complex sensed values and calculations required. Furthermore, the present machine, system and method are advantageously more accurate since a direct linear displacement measurement is employed. Another aspect advantageously mounts the linear displacement sensor adjacent to the nosepiece which improves the direct measurement and accuracy by avoiding multiple component tolerance and movement variations; this provides a direct punch position measurement relative to the nosepiece-clamped workpiece when determining and/or varying a rivet head-to-workpiece flushness condition. Additional advantages and features of the present invention will be apparent from the following description and appended claims taken in conjunction with the accompanying drawings.

DETAILED DESCRIPTION

Figure 1:
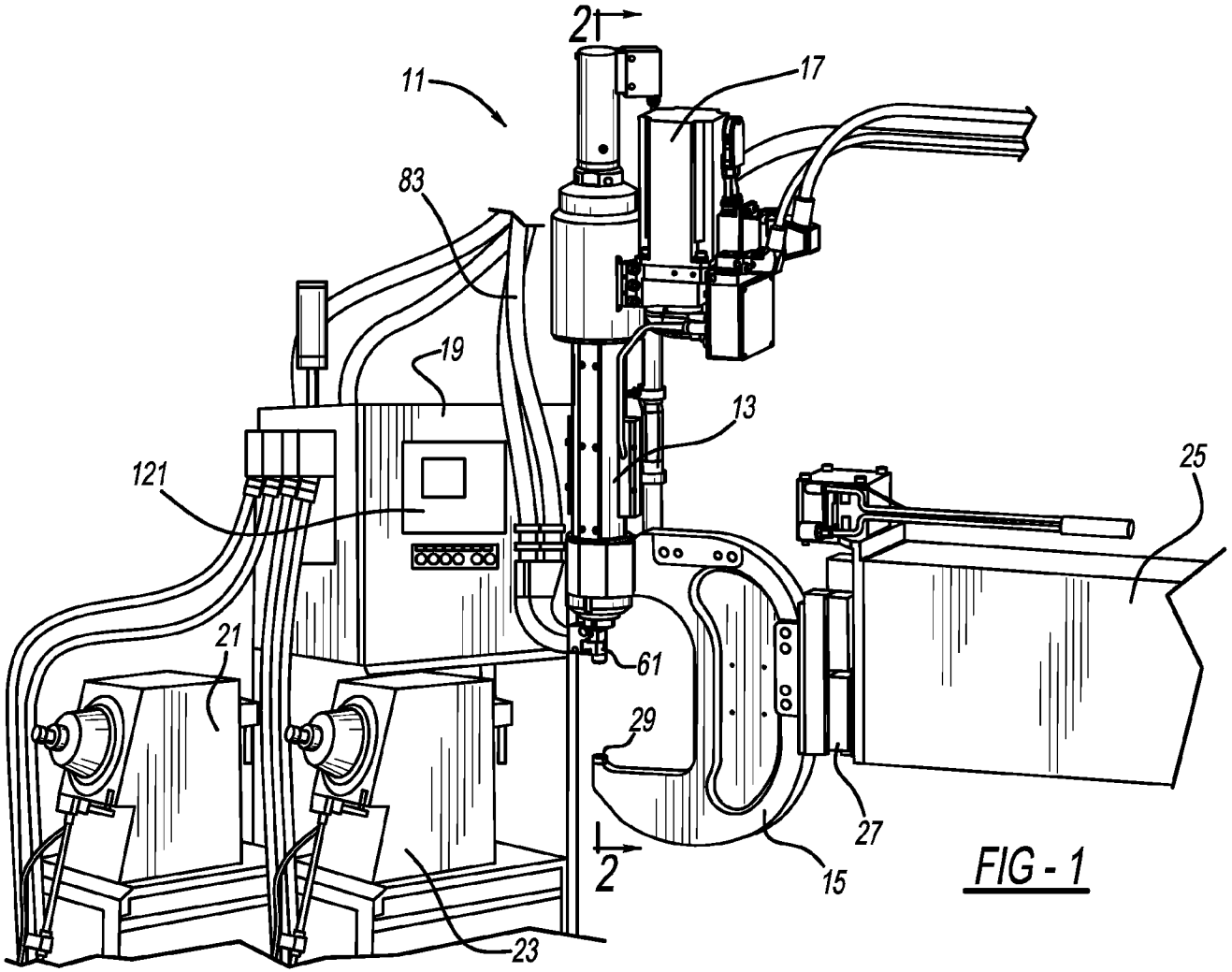
FIG. 1 is a perspective view showing a robotic embodiment of a rivet setting machine of the present invention.
Figure 2:
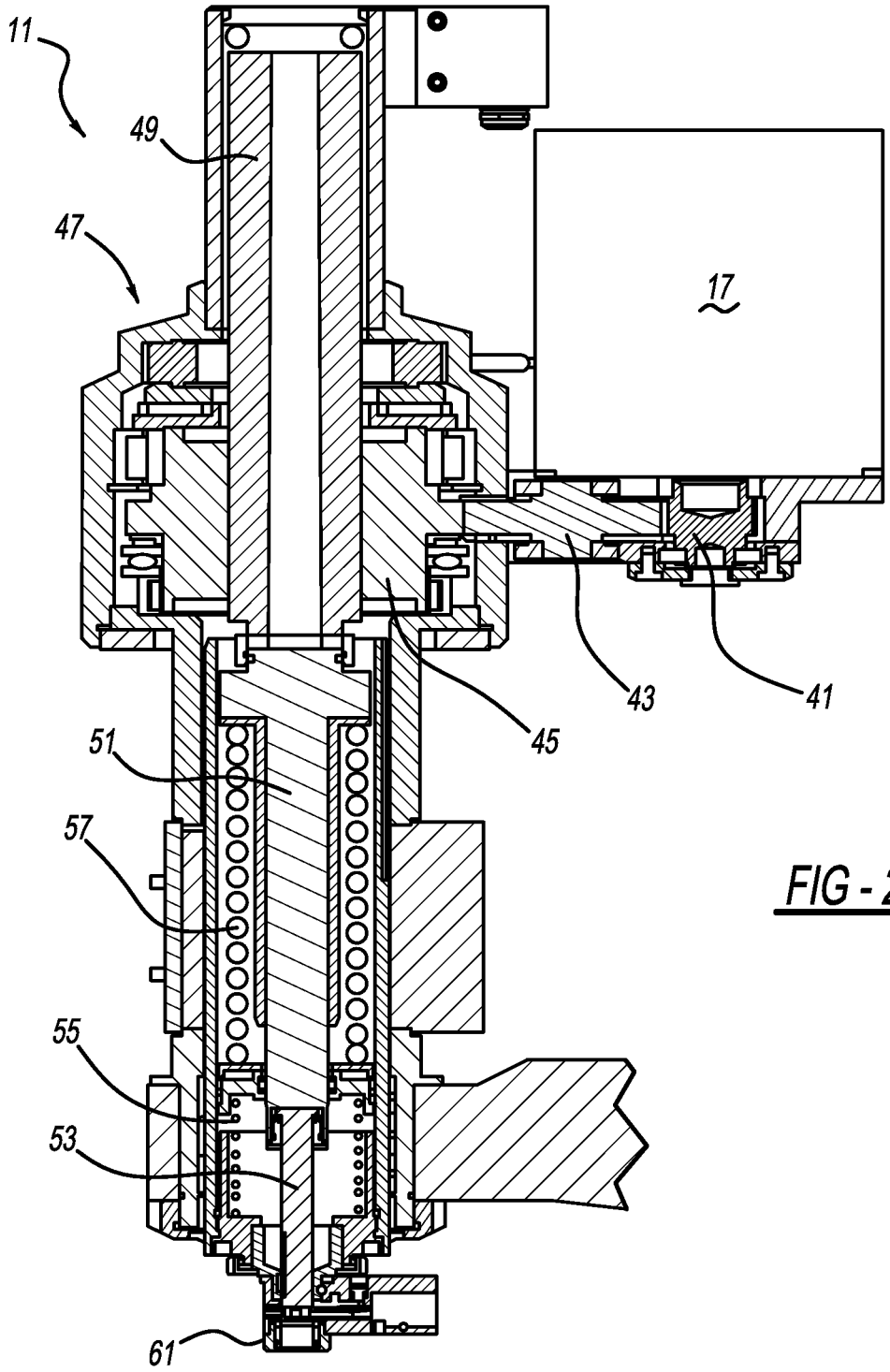
FIG. 2 is a cross-sectional view, taken along line 2-2 of FIG. 1, showing the rivet setting machine.

FIGS. 1-4 illustrate a first embodiment of a rivet setting machine 11 which includes a housing 13, a C-frame 15, an actuator 17, a programmable controller 19, rivet feeders 21 and 23, and an automatically moveable and articulated robot 25. C-frame 15 is coupled to an arm of articulated robot 25 through one or more linear slide mechanisms 27. In turn, one end of C-frame 15 is mounted to housing 13, while an opposite end of C-frame 15 retains a die 29. Housing 13 includes one or more outer protective covers.

Actuator 17 is preferably an electric motor which serves to rotate a set of gears 41, 43 and 45 of a power transmission 47. The rotation of gear 45 serves to linearly drive a longitudinally elongated spindle 49 toward and away from die 29 through a threaded interface between gear 45 (also known as a nut) and spindle 49. Additionally, a receiver rod 51 is coupled to a leading end of spindle 49, which in turn, has a punch rod 53, also known as a ram, coupled to the leading end thereof. Thus, punch 53 linearly advances and retracts in the longitudinal direction along with receiver rod 51 and spindle 49 as energized by electric motor actuator 17. During rivet setting, a light coiled compression spring 55 and a stronger coiled compression spring 57 serve to advance a nosepiece 61 to clamp sheet metal workpieces 63 and 65 against an upper surface of die 29. Workpieces 63 and 65 are preferably aluminum automotive vehicle panels but may alternately be steel.

A set of individually fed self-piercing rivets 81 are pneumatically pushed from vibratory bowl feeders 21 and 23 through elongated hoses or other conduits 83 for receipt within a lateral passageway 85 of nosepiece 61. Each self-piercing rivet 81 laterally moves past a pivoting finger 87 which is biased by a compression spring and elastomeric bumper 89 to prevent each rivet 81 from reversing direction after it is held in a fed position aligned with punch 53, as can be observed in the fed rivet and retracted punch position of FIG. 3. A proximity sensor 91, connected to controller 19, indicates if a rivet has been received in this fed position. Thereafter, the software instructions 93, stored within non-transient RAM, ROM or removable memory of controller 19, are run within a microprocessor to cause advancing energization of electric motor actuator 17. Accordingly, punch 53 pushes a head of rivet 81 toward workpieces 63 and 65, and die 29.

Figure 3:
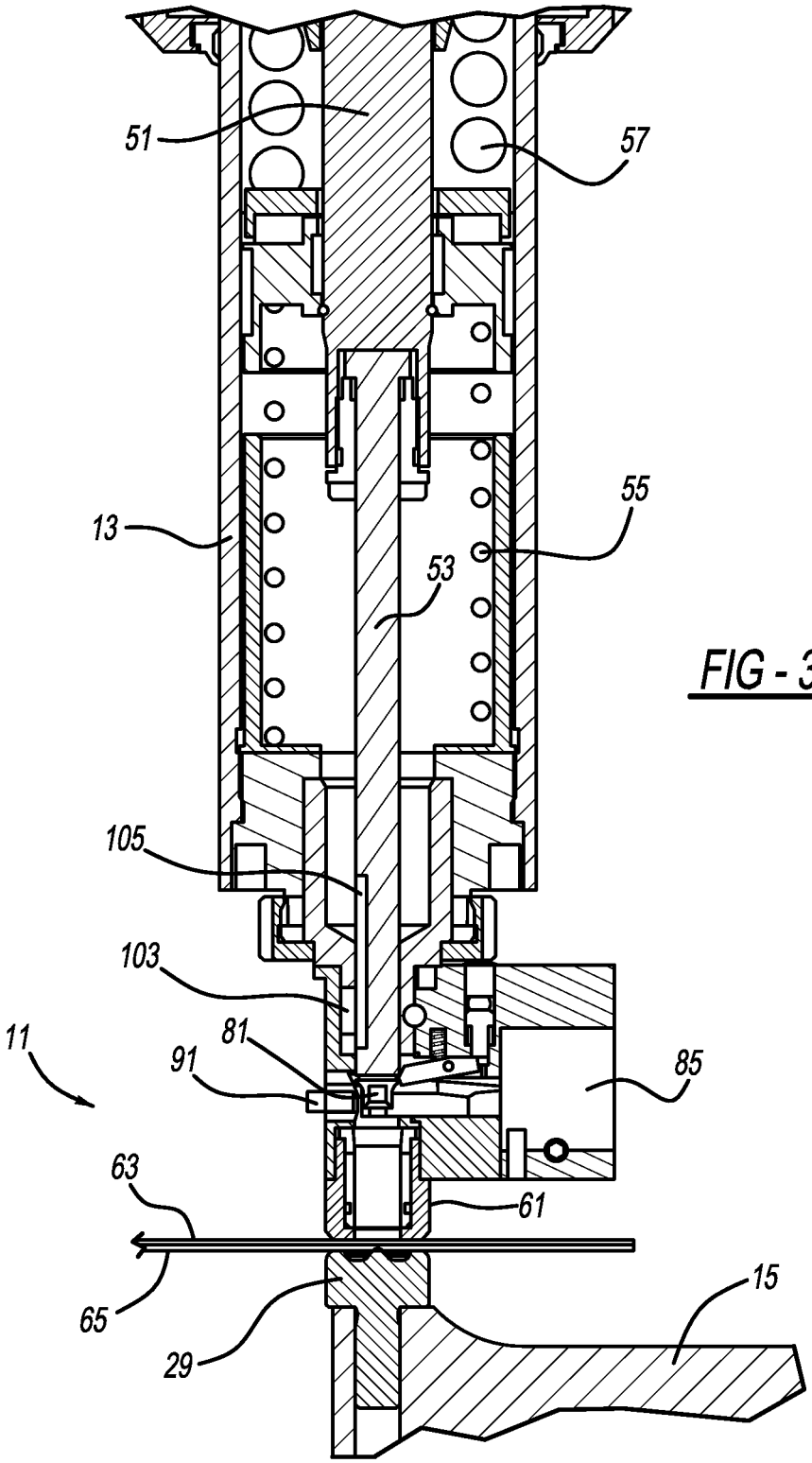
FIG. 3 is an enlarged cross-sectional view, also taken along line 2-2 of FIG. 1, showing the rivet setting machine in a first position.
Figure 4:
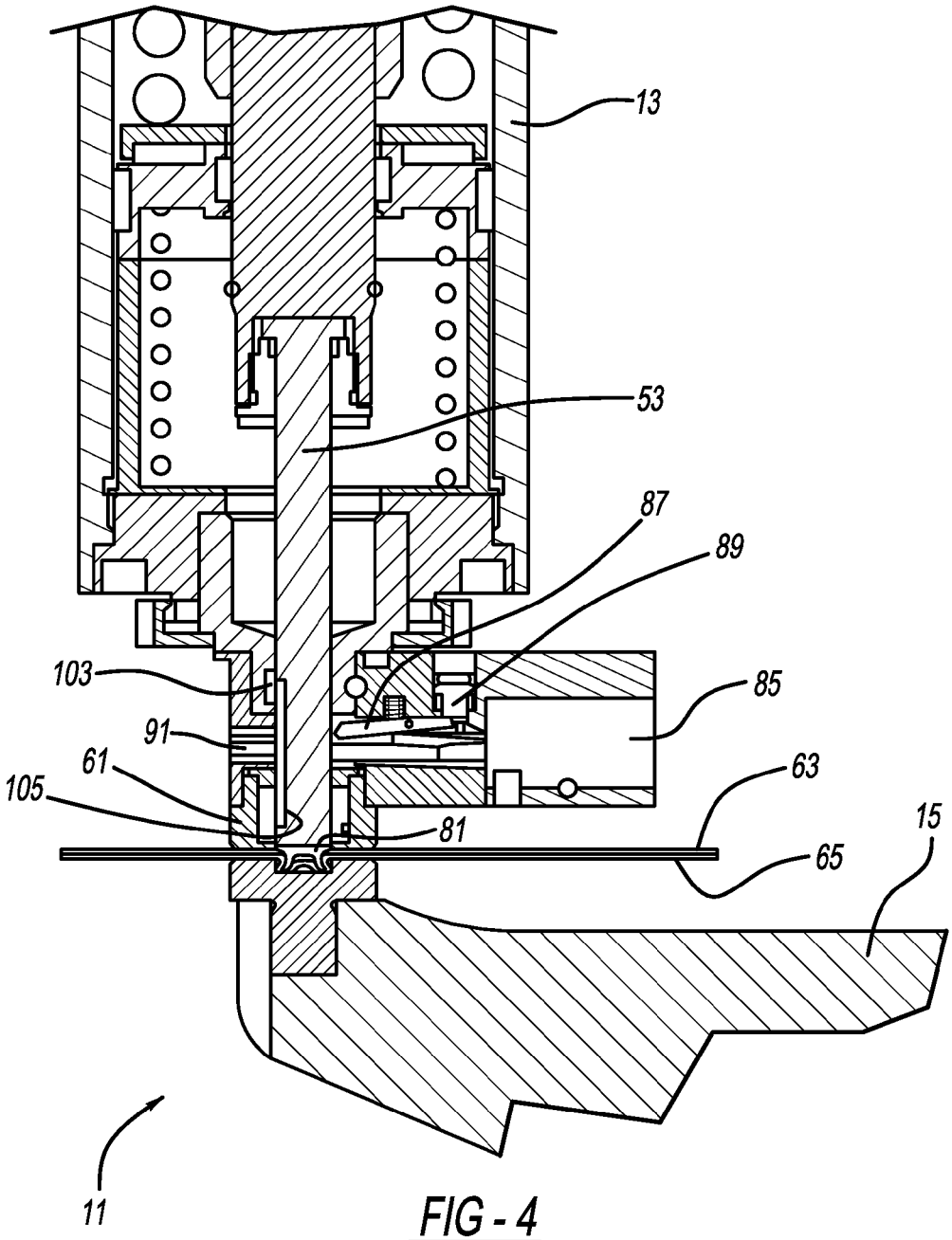
FIG. 4 is an enlarged cross-sectional view, also taken along lines 2-2 of FIG. 1, showing the rivet setting machine in a second position.
Figure 6:
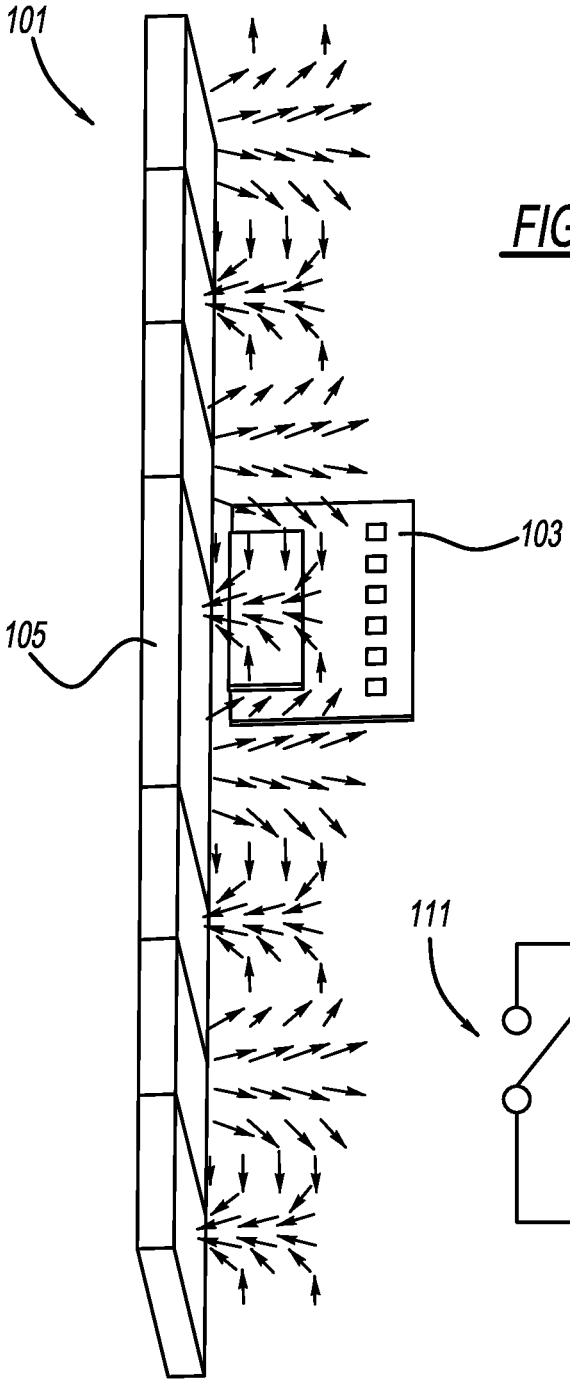
FIG. 6 is a diagrammatic view showing a magnetic linear displacement sensor employed in either embodiment rivet setting machine.

Referring now to FIGS. 3, 4 and 6, a linear displacement sensor 101 is mounted adjacent nosepiece 61 to directly detect and sense the linear position of punch 53 relative to nosepiece 61. This measurement and sensing is done with this single sensor 101, without additionally requiring sensing through a traditional force detecting load cell, electric motor current and/or voltage sensor, rotary sensing of a remotely located transmission component, or even acceleration sensing. Furthermore, the linear displacement sensor 101 is preferably a magnetic length sensor wherein a first sensor sub-component 103 is mounted to an inside cavity or surface of nosepiece 61 while a second sensor sub-component 105 is mounted to an outside cavity or surface of punch 53. As used herein, "sensor" or "detector" is intended to include both components 103 and 105. Furthermore, "nosepiece" as used herein is intended to include one or more assembly components which laterally receive the fed rivets, retain the rivets prior to punch advancement and clamp directly against an upper surface of the workpieces.

More specifically, sensor component 103 preferably includes a pair of magneto resistive Wheatstone bridges, generating two phase-shifted signals by a lateral offset, where their pole stripes meet their designed-pole pitch. Moreover, sensor component 105 is a longitudinally elongated magnetic scale which has alternating sections with oppositely directed magnetic fields therebetween. Sliding component 103 along component 105 (such as by advancing or retracting the punch relative to the nosepiece) produces sine and cosine output signals as a function of the position therebetween. Ideally, an air gap between an edge of component 103 and component 105 does not exceed half of the pole pitch. Since the sensor operating principle is based on an anisotropic magneto resistance effect, the signal amplitudes are nearly independent on the magnetic field strength and therefore, air gap variations should not have a big effect on the accuracy. Component 103 detects a magnetic radiant field and thus is almost insensitive to homogenous stray fields. Precise displacement values will be archived by using a sine/cosine decoder. Sensor component 103 operably transmits an output signal to programmable controller 19 (see FIG. 1) indicative of the relative linear location of punch 53 versus nosepiece 61. One such magnetic length sensor assembly can be obtained from Measurement Specialties, Inc. of Hampton, Va. It should alternately be appreciated that while component 105 is shown mounted to punch 53 and sensor component 103 is shown mounted to nosepiece 61, they can be reversed depending upon the packaging room available within the rivet setting machine and the accessibility of connected circuitry.

An alternate embodiment sensor assembly 101 employs an optical encoder module including a single light-emitting diode (LED) mounted to one portion of nosepiece 61, and an integrated detector circuit secured to an opposite portion of nosepiece 61, with a linear code strip moving between the emitter and detector. The code strip laterally projects from a side of punch for linear movement therewith. The light emitted by LED is culminated into a parallel beam by a single lens located directly over the LED. Furthermore, the integrated detector circuit includes multiple sets of photodetectors and signal processing circuitry necessary to produce digital wave forms. As the code strip moves between the emitter and detector, the light beam is interrupted by a pattern of spaces and bars on the code strip. The photodiodes detect these interruptions and are arranged in a pattern that corresponds to the count density of the code strip. These detectors are also spaced such that a light period on one pair of detectors corresponds to a dark period on the adjacent pair of photo detectors. The photodiode outputs are fed through the signal processing circuitry wherein two comparators receive the signals and produce final outputs sent to the programmable controller indicative of the position of the punch relative to the nosepiece. One such optical encoder module can be obtained from Agilent Technologies, Inc. as Model No. HEDS-973x.

Figure 9:
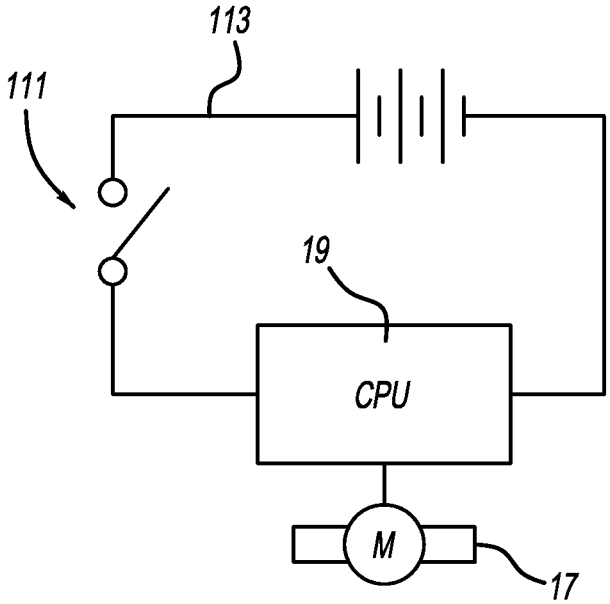
FIG. 9 is an electrical schematic diagram showing an alternate limit switch, linear displacement sensor employed in either embodiment rivet setting machine.
Figure 7A:
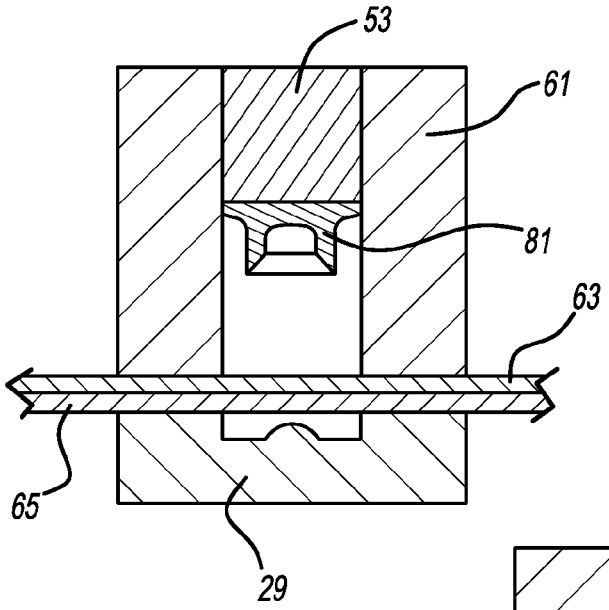
FIGS. 7A-C are a series of cross-sectional, diagrammatic views showing the movement used to set a self-piercing rivet in workpieces, employed with either embodiment rivet setting machine.
Figure 7B:
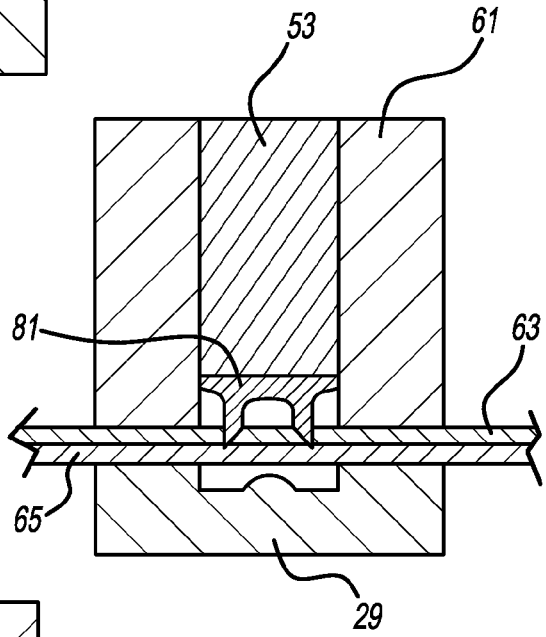
Figure 7C:
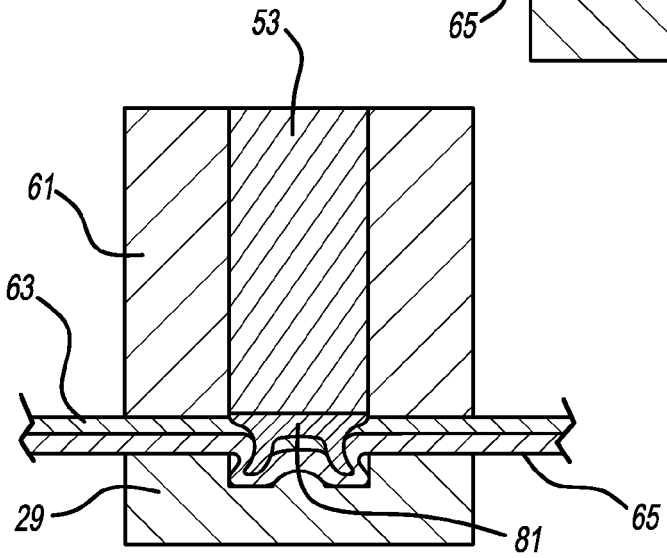
Figure 8:
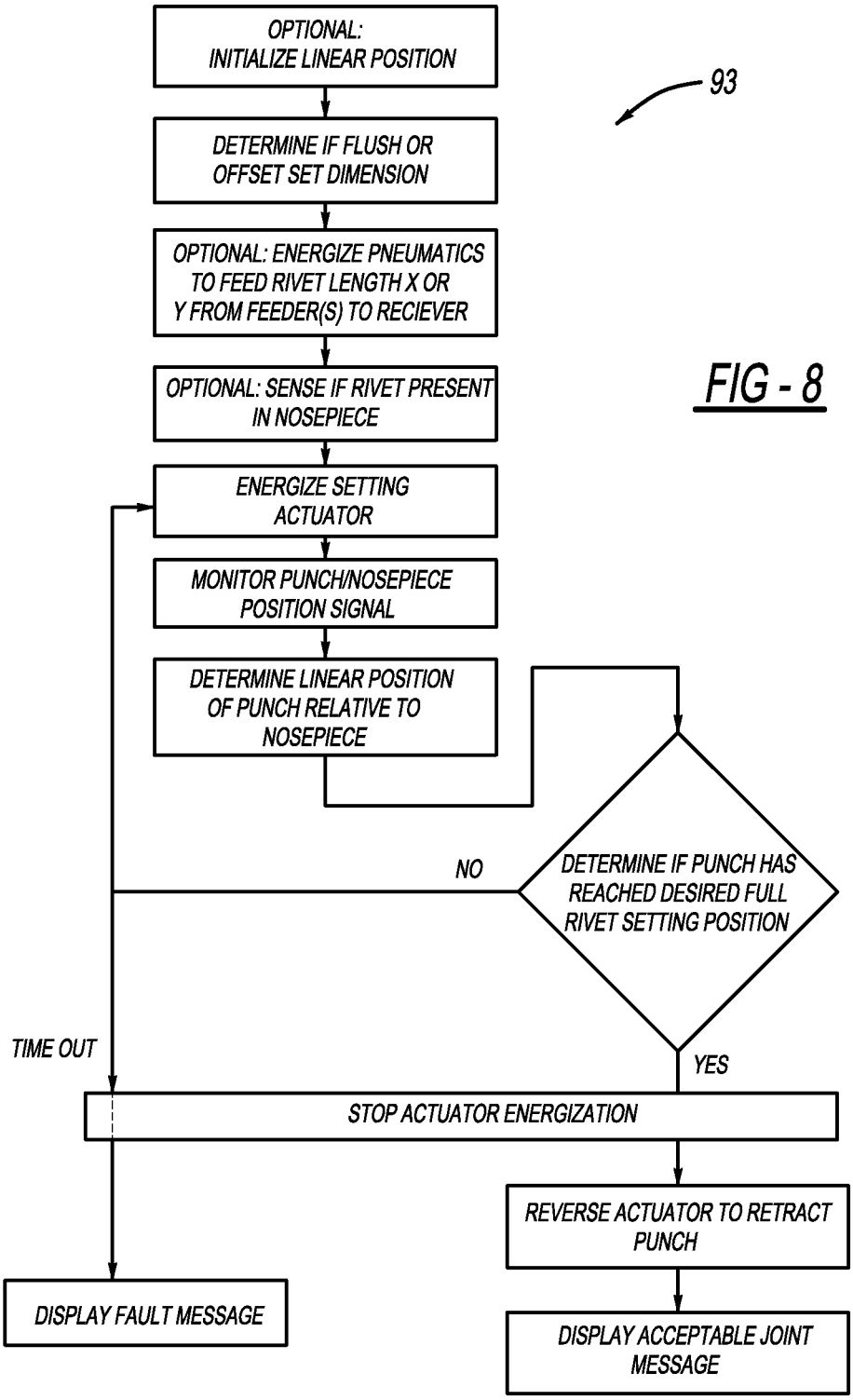
FIG. 8 is a logic flow diagram for software instructions employed in either embodiment rivet setting machine.

FIG. 9 shows still another and more simplified linear displacement sensor which includes one or more limit switches 111 connected to programmable controller through an electrical circuit 113. Limit switch 111 is mounted to an inside of nosepiece 61 and an arm or pin laterally extending from an outside of punch 53 physically or magnetically opens or closes limit switch sensor 111; this causes circuit 113 to transmit the changed output to controller 19 which indicates a relative positional change between the punch and nosepiece. Notwithstanding, while limit switch sensor 111 advantageously reduces part costs and is better suited for the lighter weight hand-held embodiment discussed hereinafter, the magnetic length sensor and optical sensors are better suited for the automatic robotic rivet setting machine embodiment to allow for punch setting positional adjustments.

Referring now to FIGS. 4, 7A-7C and 8, the rivet setting and the control logic will be discussed in greater detail. Two or more different lengths (or alternately, materials or constructions) of self-piercing rivet 81 can be set with the same rivet setting machine 11 depending upon the workpiece thicknesses or joint characteristics desired by the operator. Furthermore, the operator may desire the outer head surface of the rivet to be set in a flush condition with a punch-side planar surface of workpiece 63, over-flush such that the outer head surface of rivet 81 is below a nominal punch-side planar surface, or an under-flush condition where the head of rivet 81 is slightly proud and protruding from workpiece 63. These desired flushness characteristics and rivet length characteristics are typically pre-programmed into the programmable controller memory for each workpiece joint to be automatically riveted. Therefore, as the rivet setting machine is aligned with a new joint area to be riveted, the software instructions and the microprocessor will automatically look up these desired characteristics from the pre-stored memory data and then cause the appropriate feeder to send the desired length self-piercing rivet 81 to nosepiece 61. The controller software instructions then energizes the electric motor actuator to cause punch 53 to advance to the desired rivet setting position (such as that shown in FIGS. 4 and 7C).

This desired rivet setting/maximum advanced punch position is independent of the rivet length desired and dependent on the flushness condition desired. The present system (either robotically or manually held) allows the user to feed multiple rivet lengths and workpiece material stackup thicknesses (or quantities) into the rivet setting tool, and with one offset program input (for example, a flush setting is desired), be able to set every combination of rivet lengths and workpiece stackups without requiring an individual program or input adjustment for each; as long as a leading end of the punch is even with a leading end of the nosepiece then a good rivet/joint has been set. This provides greater flexibility of rivet and workpiece dimensions as well as increasing setting cycle speed and simplifying the machine and software. Hence, linear displacement sensor 101 is the sole sensing and detection signal used by the controller software to determine if the desired punch position has been reached, and if so, controller 19 will de-energize and then reverse the energization of the electric motor actuators so as to retract punch 53 so that the next rivet can be fed to the nosepiece for the subsequent workpiece joint. Again, no force sensing, electric motor current or voltage sensing, secondary remote sensing, or the like is required for this very quick and direct punch-to-nosepiece linear displacement monitoring. Moreover, the rivet length does not need to be sensed to determine the location of and verify that the setting position has been reached. Notwithstanding, if the desired position of punch 53 is never reached or is actually passed the desired setting position, then an associated signal will be sent from sensor component 103 to programmable controller 19 such that the software instructions will display a fault message/warning light and optionally shut down the rivet setting machine. If an acceptable joint is set as sensed by sensor component 103, an acceptable joint message is displayed on an output screen 121 (see FIG. 1) of the controller and tracked in memory for historical statistical monitoring.

It should also be appreciated that self-piercing rivets 81 advantageously pierce their own hole through an otherwise solid surface of workpieces 63 and 65. During the setting, the die shape causes the leading tubular and hollow, tapered ends of rivet 81 to outwardly diverge away from a longitudinal centerline as they travel through the die-side workpiece 65. In its fully set position, self-piercing rivet 81 is prevented from piercing completely through die-side workpiece 65 and thus, prevented from directly contacting die 29. In the embodiments disclosed herein, die 29 is always aligned with punch 53 and the workpieces must enter the opening in C-frame 15 between punch 53 and die 29.

Figure 5:
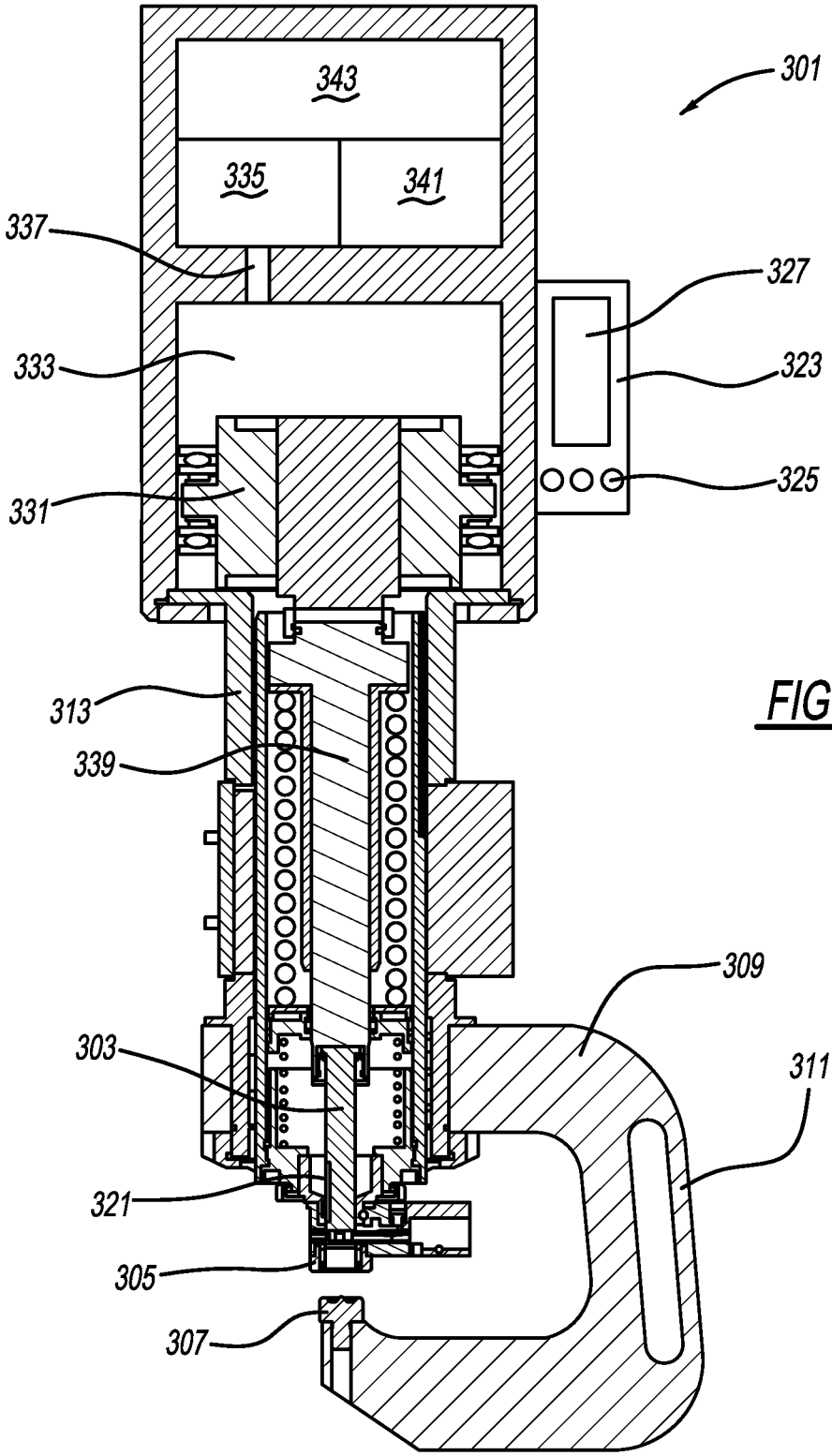
FIG. 5 is a cross-sectional view showing a hand-held embodiment of the rivet setting machine.

FIG. 5 shows a hand-held and portable rivet setting machine 301. This hand-held machine 301 has a linearly moving punch 303, nosepiece 305, die 307 and C-frame 309 very similar to those of the automated robotic embodiment previously discussed hereinabove. Furthermore, a handle 311 is provided on either or both C-frame 309 or housing 313 to allow for the operator to hold this portable rivet setting machine 301 during rivet setting. A linear displacement sensor 321 is mounted adjacent nosepiece 305 and operates like that previously discussed hereinabove. A trigger or actuation button is pushed by the operator to cause a controller to energize the actuator.

A programmable controller 323, including input buttons 325 and a display screen 327, are mounted to an exterior surface of housing 313. A fluid powered piston actuator 331 advances and retracts in a longitudinal direction within a piston chamber 333. A hydraulic or pneumatic reservoir 335 is in fluid communication with fluid chamber 333 through ports 337 in order to move piston 331, and in turn, receiver rod 339 and punch 303. A fluid pump actuator 341 is positioned within housing 313 for moving the hydraulic or pneumatic fluid and is connected to controller 323 for energization thereof. An electric battery 343 is also attached to rivet setting machine 301. Battery may optionally be rechargeable and/or removable from the machine. The direct linear displacement sensing and control logic are ideally suited for the lighter weight and simpler hand-held unit of FIG. 5 since the longer time, more expensive and heavier use of load cell sensors, electric motor resolvers and the like may not be desirable herewith.

While various embodiments of the present rivet setting machine have been disclosed, it should be appreciated that other variations may be possible. For example, the rivet setting machine power transmission may use pulleys and belts instead of or in addition to the reduction gears disclosed. Furthermore, other types of rivets can be set with the rivet sensing machine, control system and linear displacement sensor arrangement, although the many advantages of self-piercing rivets may not be realized. It should also be appreciated that some variations may employ electric motor current and/or voltage sensing, and/or transmission rotation sensing, but it is not desired to use such extra sensing functions in the punch and rivet setting location determinations and sensing. For the hand-held or even robotic machines, the rivet and flushness characteristic can be manually entered rather than pre-programmed, although this may delay the process for high quantity riveting situations. It should be appreciated that any of the constructions and functions of one embodiment may be mixed and matched with any of the other embodiments disclosed herein, such as use of fluid actuation for a robotic machine and an electro-magnetic actuation of a hand-held machine. Accordingly, such variations are not to be regarded as a departure from the present disclosure, and all such modifications are intended to be included within the scope of the present invention.

The invention claimed is:

1. A rivet setting machine comprising:

a rivet;

a nosepiece;

a feeder operably supplying the rivet to the nosepiece;

a punch linearly moving from a retracted position to an advanced position through the nosepiece;

a linear displacement sensor positioned adjacent to the nosepiece directly sensing a location of the punch relative to the nosepiece during setting of the rivet; and a programmable controller controlling actuation of the punch when the punch moves relative to the nosepiece;

wherein the linear displacement sensor further comprises a longitudinally elongated magnetic scale component and a magnetic length sensor component, one of the magnetic length sensor and magnetic scale components moving relative to the other when the punch moves relative to the nosepiece, and the magnetic length sensor component detecting a magnetic radiant field and sending a position signal to the programmable controller.

2. The machine of claim 1, further comprising:

an electric motor;

a transmission converting rotary motion of the electric motor to linear motion;

a receiver coupling the punch to the transmission to provide a retracting and advancing motion to the punch in response to forward and reverse energization of the electric motor; and the programmable controller determining a desired maximum advanced location of the punch based on an output signal from the linear displacement sensor and without the use of a setting force signal or a sensed signal associated with current/voltage of the electric motor.

3. The machine of claim 1, further comprising at least two workpieces operably joined together by the rivet which is a self-piercing rivet that does not extend through a die-side surface of the workpieces when fully set.

4. The machine of claim 1, further comprising:

a fluid powered piston;

at least a rod coupling the punch to the piston for movement therewith; and the programmable controller controlling actuation of the piston and monitoring a rivet setting punch location relative to the nosepiece without force sensing.

5. The machine of claim 1, further comprising:

a handle coupled to a housing within which the punch advances and retracts;

the nosepiece clamping workpieces during the rivet setting;

a die always being aligned with the punch during punch movement and the die being spaced from the nosepiece, the die being coupled to the housing; and the handle providing hand-held portability to the housing, punch, nosepiece and die.

6. The machine of claim 1, further comprising a robot automatically moving the housing within which the punch operably advances and retracts, the die being coupled to the housing and being aligned with the punch to assist in the rivet setting, and the nosepiece clamping workpieces during the rivet setting.

7. The machine of claim 1, wherein the linear displacement sensor further comprises a limit switch activated by movement of the punch relative to the switch which causes the switch to change an output signal sent to the programmable controller which, in turn, controls actuation of the punch.

8. The machine of claim 1, further comprising:

an actuator causing the punch to move from the retracted position to the advanced and rivet setting position;

the programmable controller connected to the actuator; and software instructions stored in memory of the programmable controller using an output signal of the linear displacement sensor to cause the punch to intentionally move to an over-flush rivet setting position or an under-flush rivet setting position depending upon a desire set position signal.

9. A rivet setting machine comprising:

a rivet;

a nosepiece;

a feeder operably supplying the rivet to the nosepiece;

a punch linearly moving from a retracted position to an advanced position through the nosepiece;

a linear displacement sensor positioned adjacent to the nosepiece directly sensing the location of the punch relative to the nosepiece during setting of the rivet; and a programmable controller connected to the linear displacement sensor, the programmable controller using an output signal from the linear displacement sensor to control the rivet setting advanced location of the punch for both the rivet which is of a first length and a second rivet which is of a different length, without sensing the actual rivet length.

10. The machine of claim 9, wherein:

the programmable controller controls actuation of the punch when the punch moves relative to the nosepiece; and the linear displacement sensor further comprises a longitudinally elongated magnetic scale component and a magnetic length sensor component, one of the magnetic length sensor and magnetic scale components moving relative to the other when the punch moves relative to the nosepiece, and the magnetic length sensor component detecting a magnetic radiant field and sending a position signal to the programmable controller.

11. The machine of claim 9, further comprising:

an electric motor;

a transmission converting rotary motion of the electric motor to linear motion;

a receiver coupling the punch to the transmission to provide a retracting and advancing motion to the punch in response to forward and reverse energization of the electric motor; and at least two workpieces operably joined together by the rivet which is a self-piercing rivet that does not extend through a die-side surface of the workpieces when fully set.

12. The machine of claim 9, further comprising:

a robot automatically moving a housing within which the punch operably advances and retracts;

a die coupled to the housing and being aligned with the punch to assist in the rivet setting and clamping workpieces during the rivet setting by the nosepiece;

an actuator causing the punch to move from the retracted position to the advanced and rivet setting position;

the programmable controller connected to and controlling energization of the actuator; and software instructions stored in memory of the programmable controller using an output signal of the linear displacement sensor to cause the punch to intentionally move to an over-flush rivet setting position or an under-flush rivet setting position depending upon a desire set position signal.

13. A rivet setting machine comprising:

a rivet;

a nosepiece including a bore longitudinally extending therethrough, the nosepiece being movable to a workpiece-contacting position prior to or during rivet setting;

a punch linearly retracting and advancing through the bore of the nosepiece;

a linear displacement sensor directly sensing location of the punch relative to the nosepiece, a first component of the linear displacement sensor being moveable with the punch when it advances, and a second component of the linear displacement sensor being positioned adjacent the nosepiece and separate from the first component which is moveable relative to the second component; and a programmable controller determining the linear punch displacement relative to the nosepiece during the rivet setting based on an output from the linear displacement sensor but without force sensing, rotation sensing or current/voltage sensing.

14. The machine of claim 13, further comprising:

an electric motor;

a transmission converting rotary motion of the energized electric motor to linear motion; and a receiver coupling the punch to the transmission to provide the retracting and advancing motions to the punch in response to forward and reverse energization of the electric motor;

the programmable controller determining a desired maximum advanced location of the punch solely based on the output from the linear displacement sensor.

15. The machine of claim 13, further comprising at least two workpieces operably joined together by the rivet which is a self-piercing rivet that does not extend through a die-side surface of the workpieces when fully set.

16. The machine of claim 13, further comprising:

a fluid powered piston; and at least a rod coupling the punch to the piston for movement therewith;

the programmable controller controlling actuation of the piston.

17. The machine of claim 13, wherein the programmable controller uses the output from the linear displacement sensor to control the rivet setting advanced location of the punch for both the rivet which is of a first length and a second rivet which is of a different length.

18. The machine of claim 13, further comprising:

a housing within which the punch advances and retracts;

the nosepiece being coupled to the housing;

a die aligned with the punch and spaced from the nosepiece, the die being coupled to the housing; and a handle providing hand-held portability to the housing, punch, nosepiece and die.

19. The machine of claim 13, further comprising:

an actuator causing the punch to linearly move from a retracted position to an advanced and rivet setting position;

the programmable controller connected to the actuator; and software instructions stored in memory of the programmable controller using the output of the linear displacement sensor to cause the punch to intentionally move to an over-flush rivet setting position or an under-flush rivet setting position depending upon a desire set position signal.

20. The machine of claim 13, wherein the first component is directly mounted on the punch and the second component is directly mounted on the nosepiece, and at least one of the components is electrically connected to the programmable controller.

21. The machine of claim 13, wherein at least one of the components of the linear displacement sensor is elongated in a direction substantially parallel to an elongated axis of the punch.

22. The machine of claim 13, wherein one of the components of the linear displacement sensor is a magnetic scale including alternating magnetic sections which generates phase-shifted signals.

23. The machine of claim 13, wherein one of the components of the linear displacement sensor includes a light-emitter and another of the components of the linear displacement sensor includes a linear code strip having a sensing pattern thereon.

24. A rivet setting machine comprising:

a self-piercing rivet;

a nosepiece;

a punch linearly moveable in the nosepiece to set the rivet;

a housing surrounding at least part of the punch;

a die always being aligned with the punch during punch movement;

a frame coupling the die to the housing;

a handle coupled to at least one of the frame and the housing allowing for hand-held portability of at least the nosepiece, punch and die;

a single sensor detecting a linear displacement of the punch relative to the nosepiece, an elongated component of the sensor being moveable with the punch when it advances and a second component of the linear displacement sensor being coupled to and moveable with the nosepiece; and a programmable controller monitoring a rivet setting position of the punch based on an output from the single sensor.

25. The machine of claim 24, further comprising:

an electric motor;

a transmission converting rotary motion of the energized electric motor to linear motion;

a receiver coupling the punch to the transmission to provide retracting and advancing motions to the punch in response to forward and reverse energization of the electric motor; and a proximity sensor connected to the programmable controller, detecting the presence of the rivet in the nosepiece;

the programmable controller determining a desired maximum advanced location of the punch based on the output from only the linear displacement sensor and without the use of a setting force signal or a sensed signal associated with current/voltage of the electric motor.

26. The machine of claim 24, further comprising:

a fluid powered piston; and a rod coupling the punch to the piston for movement therewith;

the programmable controller controlling actuation of the piston and monitoring a rivet setting punch location relative to the nosepiece without force sensing.

27. The machine of claim 24, wherein the programmable controller controls actuation of the punch when the punch moves relative to the nosepiece, wherein the linear displacement sensor further comprises a longitudinally elongated magnetic scale and a magnetic length sensor, at least one of which being the elongated component, one of the magnetic length sensor and magnetic scale components moving relative to the other when the punch moves relative to the nosepiece, and the magnetic length sensor component detecting a magnetic radiant field and sending a position signal to the programmable controller.

28. The machine of claim 24, wherein the linear displacement sensor further comprises a limit switch activated by movement of the punch relative to the switch which causes the switch to send the output to the programmable controller.

29. The machine of claim 24, further comprising:

an actuator causing the punch to move from a retracted position to an advanced and rivet setting position; and software instructions stored in memory of the programmable controller using the output of the linear displacement sensor to cause the punch to move to an over-flush rivet setting position or an under-flush rivet setting position depending upon a desire set position signal.

* * * * *